US007556129B2

(12) United States Patent
Nix

(10) Patent No.: US 7,556,129 B2
(45) Date of Patent: Jul. 7, 2009

(54) MOTOR BRAKE

(75) Inventor: Robert J. Nix, Algonquin, IL (US); Dorene K. Nix, legal representative, Algonquin, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 644 days.

(21) Appl. No.: 11/306,001

(22) Filed: Dec. 14, 2005

(65) Prior Publication Data

US 2007/0131496 A1 Jun. 14, 2007

(51) Int. Cl.
*F16D 55/08* (2006.01)

(52) U.S. Cl. ..... 188/72.9; 53/399; 173/156; 310/77; 318/370

(58) Field of Classification Search ..... 188/72.9, 188/157, 158, 162; 53/399, 582; 192/26, 192/43, 47, 223.2, 223.4; 173/156, 164, 173/166; 310/76, 77; 318/370, 372
See application file for complete search history.

(56) References Cited

U.S. PATENT DOCUMENTS

| | | | | |
|---|---|---|---|---|
| 6,338,375 | B1 * | 1/2002 | Harada | 156/391 |
| 6,907,717 | B2 | 6/2005 | Nix | |
| 2003/0056337 | A1 * | 3/2003 | Scholl et al. | 24/69 TM |
| 2003/0221566 | A1 * | 12/2003 | Apel et al. | 100/29 |
| 2006/0186258 | A1 * | 8/2006 | Ubertini | 242/564 |

FOREIGN PATENT DOCUMENTS

| | | |
|---|---|---|
| DE | 100262000 | 11/2001 |
| EP | 1357033 | 10/2003 |
| EP | 1371560 | 12/2003 |
| GB | 1562333 | 3/1980 |
| WO | WO2005/002972 | 1/2005 |
| WO | WO2005070766 | 8/2005 |

OTHER PUBLICATIONS

International Search Report for PCT/US06/042429 dated Feb. 22, 2007.

* cited by examiner

*Primary Examiner*—Pam Rodriguez
(74) *Attorney, Agent, or Firm*—Levenfeld Pealstein, LLC

(57) ABSTRACT

A brake assembly is configured for a strapping tool tensioning motor. The brake assembly includes a one-way bearing operably connected to the motor output shaft. The bearing has at least two stop members. A brake element is mounted to the motor movable toward and away from the bearing for movement into and out of engagement with one of the bearing stop members. A brake release is connected to the brake element. The brake element is biased into engagement with a bearing stop member. When the brake is engaged with the bearing stop member, the motor can freely rotate in the first direction and cannot rotate in the second reverse direction. The brake release moves the brake element out of engagement with the one of the bearing stop members and the motor can freely rotate in the second reverse direction until the brake release is reengaged with one of the bearing stop members.

18 Claims, 4 Drawing Sheets

MOTOR BRAKE

BACKGROUND OF THE INVENTION

The present invention pertains to an improved brake and release for a strapping tool. More particularly, the present invention is directed to a one-way clutch brake and release for a powered strapping tool.

Strapping tools are well-known in the art. These tools come in a wide variety of types, from fully manual tools to automatic, table-top tools. These tools are generally specifically designed for use with metal strapping or plastic/polymeric type strapping.

A strapper for applying plastic or polymeric strapping materials is powered to provide energy for tensioning the strap and adhering the strapping material onto itself. A typical strapper tool includes a body, one or more motors, a foot (which rests on the load), a tensioning wheel, a vibrating or sealing element and, typically, a pneumatic module to route air and provide control of the tool.

In use of the tool, first and second courses of strap material are passed over the foot of the tool, between the foot and the tensioning wheel. The strap is tensioned by rotation of the wheel. As the strap is tensioned, is also tightens onto the tool foot, holding the foot to the load. The strap is sealed to itself (as by welding) and the free end of the strap is cut. Although this does in fact strap the load, it also retains the tool (at the foot) sealed to the load.

To permit removing the tool from the load, the many tools are configured to allow the tensioning wheel to rollback, a small amount. This retains the strap in tension, but releases tension just enough to allow the tool foot to be pulled from between the strap and the load.

Various arrangements are known for permitting a light amount of rollback. For example, pneumatic systems are known that use a delay in the pneumatic circuit that permits a slight rollback following tensioning. Other strapping tools use a complex gearing arrangement to permit rollback.

Accordingly, there is a need for a simplified motor brake and release arrangement that provides rollback in a strapping tool. Desirably, such an arrangement eliminates the need for pneumatics in providing rollback. Most desirably, such a brake and release arrangement provides a positive brake from excessive rollback.

BRIEF SUMMARY OF THE INVENTION

A brake assembly is configured for use with a tensioning motor for a strapping tool. The motor has a housing and an output shaft operably connected to a tensioning wheel. The tensioning wheel rotates in a first direction to tension the strap and in a second reverse direction to relieve tension in the strap. Tension release is required to be able to remove the tool from the load being strapped. However, the loosening or rollback must be controlled to prevent excessive slack in the strap.

The brake assembly includes a one-way bearing operably connected to the motor output shaft. The bearing permits the shaft to rotate relative to the bearing in the first direction and prevents rotation of the shaft relative to the bearing in the reverse direction. The bearing has at least two (and preferably two) stop members thereon.

A brake element is operably mounted to the motor housing and is movable toward and away from the bearing for movement into and out of engagement with one of the bearing stop members. The brake element stops reverse rotation of the motor shaft and bearing when the brake element is engaged with one of the bearing stop members.

A brake release is operably connected to the brake element for moving the brake element into and out of engagement with the bearing stop member. A biasing element biases the brake element into engagement with the bearing stop member.

When the brake is engaged with the bearing stop member, the motor can freely rotate in the first direction (to tension the strap) but cannot rotate in the second reverse direction. When the brake release moves the brake element out of engagement with the bearing stop member, the motor (and bearing) can freely rotate in the reverse direction to slightly loosen the strap, until the brake release is reengaged with one of the bearing stop members.

In a present brake assembly, the bearing includes a circumferential trough formed therein and includes outwardly extending projections that form the stop members. A preferred bearing includes two stop members.

The brake release is pivotally mounted to the motor housing by a pivot. A finger release is spaced from the pivot and the brake element is operably connected to the brake release between the finger release and the pivot.

In a present assembly, a cam operably connects the brake release and the brake element. The cam is configured to translate movement of the brake release into an opposite movement of the brake element.

In one embodiment, the cam includes a central disk portion and a pair of pins extending outwardly from opposing side surfaces of the disk. The pins are disposed about 180 degrees from one another. The brake release and the brake element each include a slot to receive their respective pins.

The brake release is biased to maintain the brake element in the engaged position. The biasing element is disposed between the pivot and the finger release, and more particularly, between the finger release and the cam.

A strapper motor is also disclosed.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
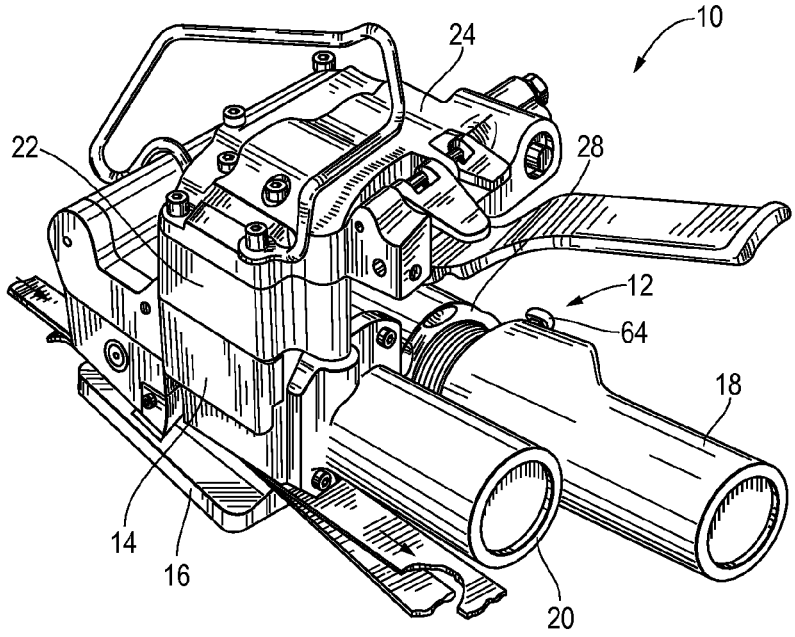
FIG. 1 is a perspective view of an exemplary strapping tool having a motor brake embodying the principles of the present invention.
Figure 2:
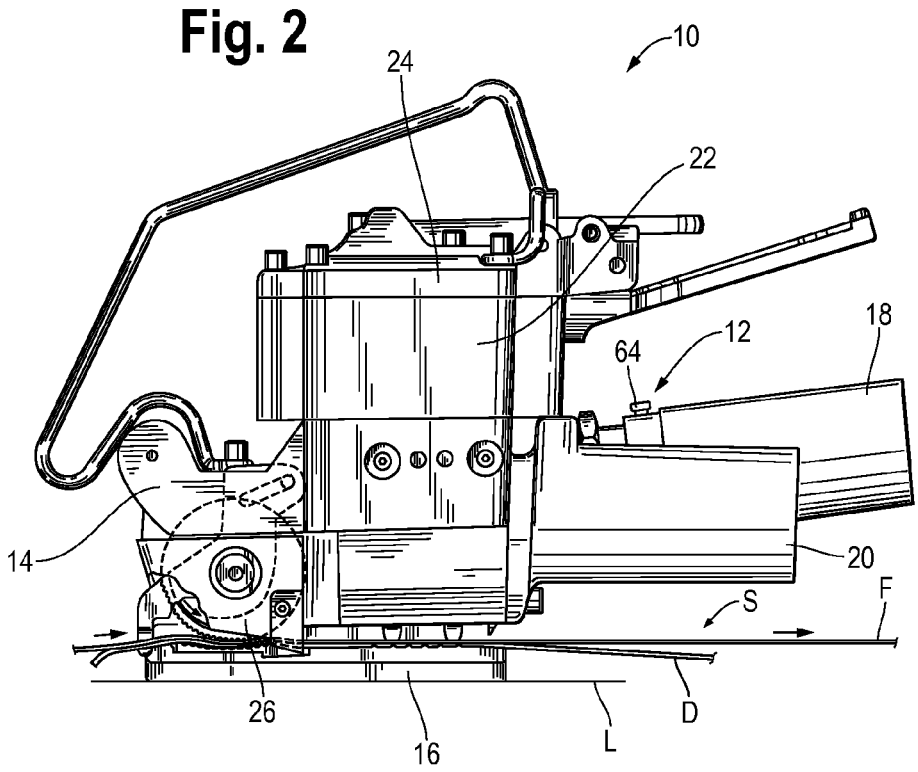
FIG. 2 is a side view of the strapper.
Figure 3:
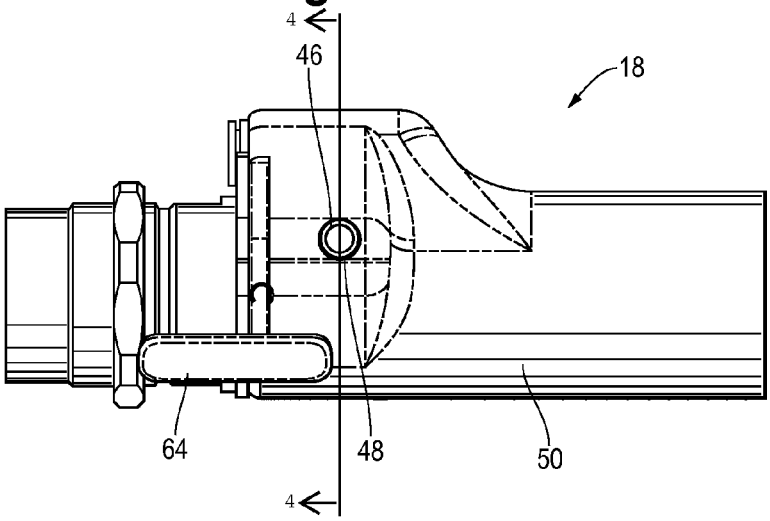
FIG. 3 is a side view of the strapper tensioning motor.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring now to the figures and in particular to FIG. 1, there is shown an exemplary pneumatic motor strapper or strapping tool 10 that has a motor brake 12 embodying the principles of the present invention.

The tool 10 is configured to tension a strap S around a load L, weld the strap S material onto itself and sever a feed end F of the strap S. For purposes of the present disclosure, the strap S material will be referred to as having a feed end F which is the supply end of the material and a free end D which is that end of the material that is fed around the load L and reinserted into the strapping tool 10.

The tool 10 includes, generally, a body 14, a foot 16, a tensioning motor 18, a weld motor 20, a housing 22 and a pneumatic module 24. The pneumatic module 24 is mounted to the housing 22 which is mounted to the body 14 and provides pneumatic pathways between the module 24, the housing 22 and the tensioning and welding motors 18, 20, for introducing and venting a compressed gas, such as compressed air, to and from the motors 18, 20. An exemplary tool is disclosed in Nix, U.S. Pat. No. 6,907,717, which patent is commonly assigned with the present application and is incorporated herein by reference.

The tensioning motor 18 is pneumatic actuated and drives a tensioning wheel 26. It will be appreciated that the power output of the pneumatic motor 18 is low, whereas the force required to tension the strap S is relatively high. Accordingly, the drive or transmission 28 (operably connecting the motor 18 to the wheel 26) is at a relatively high gear ratio, on the order of about 20:1 to 30:1. Thus, the output shaft 30 of the motor 18 rotates a relatively high speed, but at low power, and the transmission 28 translates the high speed/low power output at the shaft 30 to high power/low speed at the tension wheel 26.

In use of the tool 10, first and second courses F, D of strap S material are passed over the foot 16 of the tool 10, between the foot 16 and the tensioning wheel 26. The strap S is tensioned by actuation of the tensioning motor 18 which rotates the tensioning wheel 26. As the strap S is tensioned, it also tightens onto the foot 16, holding the foot 16 to the load L. The strap S is sealed to itself (as by welding) and the free end F of the strap S is cut. Although this does in fact strap the load L, it also retains the tool 10 (at the foot 16) tightly held to the load L.

As set forth above, prior known strappers use a pneumatic system and/or a complex gearing arrangement to permit rollback. It will be appreciated that the amount of rollback must be controlled so that the strap S does not become overly slack. Accordingly, the present brake assembly 12 includes a one-way bearing 34 that is mounted to the motor output shaft 30 and a cooperating brake assembly 36. The bearing 34 and brake assembly 36 permits the motor shaft 30 to freely rotate relative to the bearing in one direction (forwardly), the tensioning direction, but prevents (rearward) rotation in an opposite direction. The bearing 34 includes at least one and preferably a pair of generally radially outwardly oriented stops 38. The stops 38 extend outwardly from a circumferential lip 40 on the bearing 34 at the bore 42 through which the shaft 30 extends.

In a present bearing 34 and brake assembly 36, the bearing 34 is formed as a collar with a circumferential channel 44 formed therein. The stops 38 are formed as wall portions that extend into the channel 44. The stops 38 are generally radially formed, oriented slightly tangential, as will be described below (see FIG. 9).

The assembly 36 includes a plunger 46 that is fitted into an opening 48 in the motor housing 50. The plunger 46 is configured to move in and out (toward and away from the bearing 34) along a line $A_{46}$ that projects through the central axis $A_{18}$ of the motor 18 and shaft 30. A finger 52 at the end of the plunger 46 moves into the channel 44 to engage one of the stops 38 and to disengage from the stop 38. The plunger 46 is biased in the engaged position by a spring 54. When the plunger 46 is in the engaged position it contacts the stop 38 to prevent the motor 18 from rotating in the reverse direction. The plunger 46 includes a slot 56 formed therein.

A manual brake release lever 58 is mounted to the motor housing 50. The brake lever 58 includes a body 60 that is received in the housing 50. The body 60 is mounted to the housing 50 at a pivot 62. A finger release 64 is mounted to the body 50 spaced from the pivot 62 to actuate or move the lever 58. An elongated slot 66 is formed in the body 60 between the finger release 64 and the pivot 62.

A cam 68 is mounted between the finger release 64 and the plunger 46. The cam 68 has a round, disk-like body 70 with pins 72, 74 extending from the disk 70, on opposite sides thereof. The pins 72, 74 are mounted about 180 degrees from one another.

One of the pins 72 is received in the brake release lever body slot 66 and the other pin 74 is received in the plunger slot 56. The lever slot/cam/plunger slot (66/68/56) arrangement serves to translate the downward movement of the release lever finger pad 64 to an upward movement of the plunger 46. That is, because the pins 72, 74 are located 180 degrees from one another, as the release lever pin 72 is urged inward by depressing the pad 64, it rotates the central disk 70, which in turn rotates the plunger pin 74 upward (or outwardly) to move the plunger finger 52 out of engagement with the bearing stop 38. The elongated slots 66, 56 in the lever body 60 and plunger 46, permit movement without binding between the pins 72, 74 and their respective openings, 66, 56. This permits the bearing 34 and motor 18 to rotate in the rearward direction.

Figure 4:
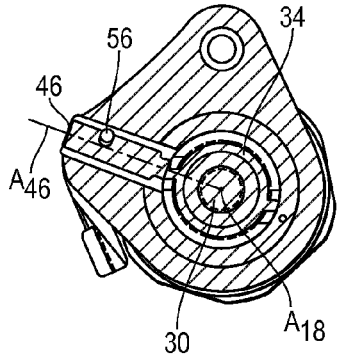
FIG. 4 is a cross-sectional view taken along line 4-4 of FIG. 3.
Figure 5:
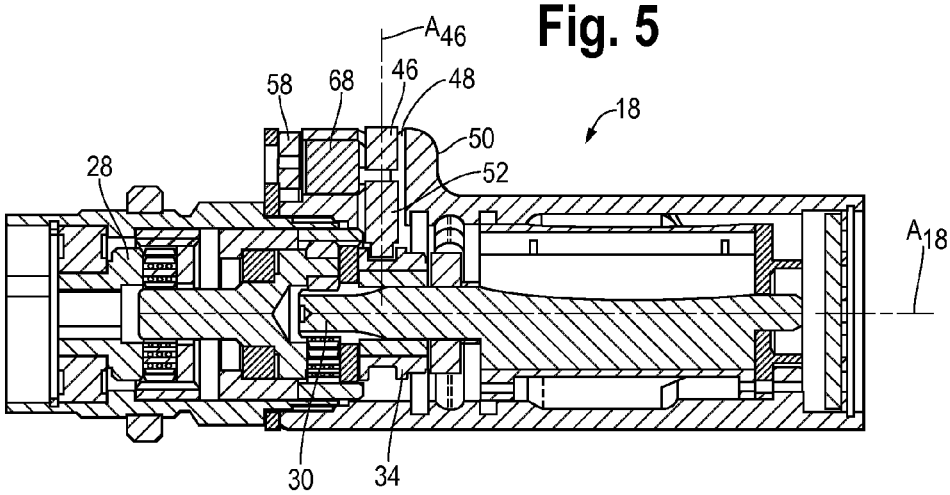
FIG. 5 is a longitudinal cross-sectional view of the motor.
Figure 6:
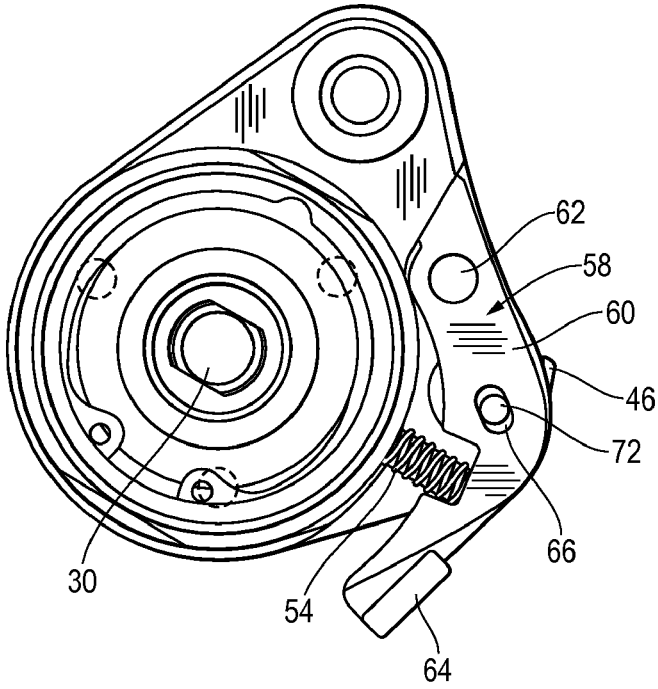
FIG. 6 is a sectional view illustrating the brake release.
Figure 7:
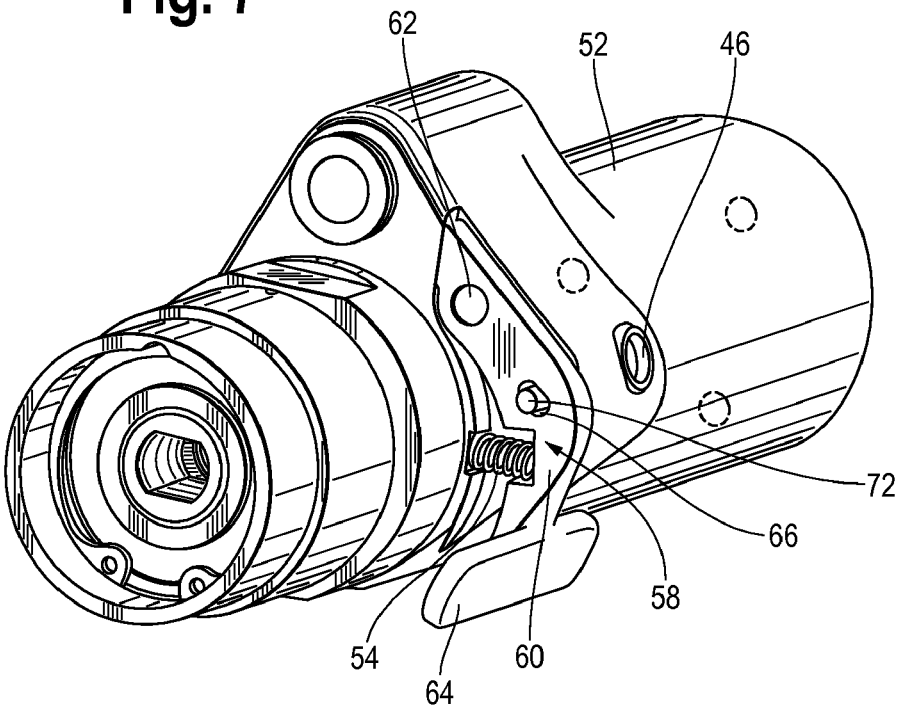
FIG. 7 is a perspective view of the motor showing the release.
Figure 8:
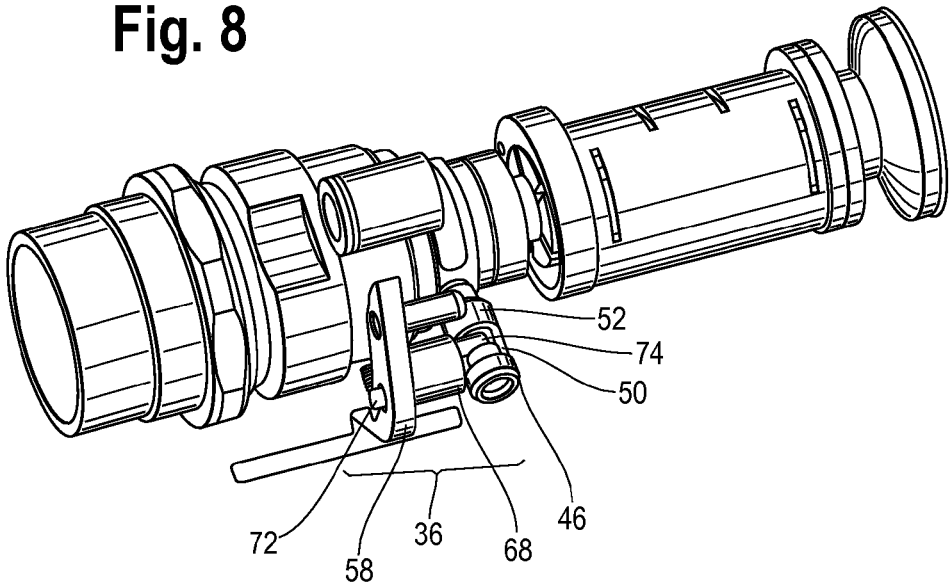
FIG. 8 is an exploded view of the brake release, cam and plunger.
Figure 9:
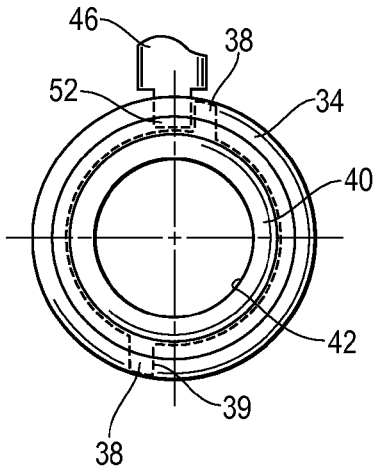
FIG. 9 is a front view of the bearing.
Figure 10:
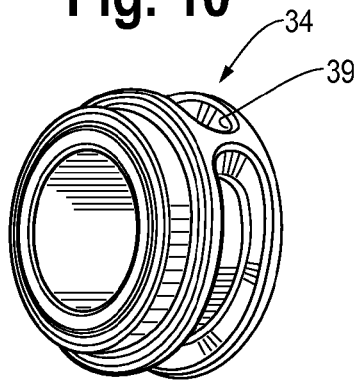
FIG. 10 is a wire frame perspective illustration of the bearing.
Figure 11:
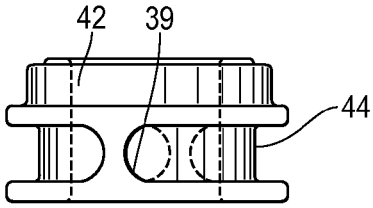
FIG. 11 is a top view of the bearing.
Figure 12A:
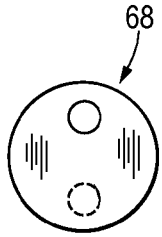
FIGS. 12A and 12B are front and side views of the cam.
Figure 12B:
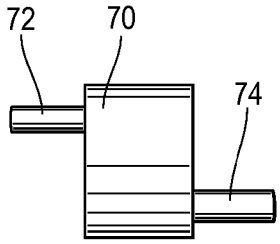

As can be seen from FIGS. 4 and 9, when the plunger 46 is engaged with the bearing stop 38, the finger 52 contacts the stop 38 to prevent rearward rotation of the bearing 34 and motor 18. The location and orientation of the stops 38 are such that the finger 52 rests against the surface of the stop 38, rather than contact merely at a point on the stop 38. In addition, as seen in FIG. 10, the wall (as indicated at 39) that defines the stop 38 is rounded (along with the finger 52), again, to maintain a relatively large contact area to facilitate ready disengagement of the finger 52 from the stop 38.

In use, as the tool 10 is in tension mode, the motor 18 rotates clockwise (as seen in FIG. 4), the plunger 46 is in the engaged position, but the motor shaft 30 rotates freely relative to the one-way bearing 34. The bearing 34 may nevertheless rotate clockwise with the shaft 30 until the rear side of the stop 38 contacts the finger 52.

When the motor 18 is stopped (that is, when air to the motor 18 is isolated), the tension in the strap S pulls the tension wheel 26 in the reverse direction. Since the motor 18 and tension wheel 26 are connected to one another (by the gear set or transmission 28), the motor 18 will begin to rotate rearward or counterclockwise (in FIG. 4), until the bearing stop 38 hits or engages the finger 52. This will stop rearward rotation of the tension wheel 26 and motor 18.

With the finger 52 engaged with the stop 38, the tension in the strap S is too great to remove the tool 10 from the load L. In order to "release" the tool 10 the tension wheel 26 must be permitted to slightly rollback to slightly reduce the tension in the strap S. However, it will be appreciated that too much rollback is not desirable in that excessive slack can result.

By depressing the finger release 64 the plunger finger 52 moves outward to release the brake 36. The tension in the strap S pulls the tension wheel 26 rearward because the plunger 46 is out of engagement with the brake stop 38. Because the brake assembly 36 is biased, releasing the finger release 64 allows the plunger 46 to reengage the brake stop 38 and stop the wheel 26 from rearward rotation.

Although release of the brake 36 can result in a ½ rotation (e.g., 180 degree rotation) of the motor 18 (until the opposing stop 38 engages the finger 52), because of the gear ratio of the motor 18 and tension wheel 26 (about 20:1 to 30:1), that ½ rotation of the motor 18 translates into about 1/50 rotation of the tension wheel 26. Thus, excessive loosening of the strap does not occur.

In order to release the tool 10 from the tensioned strap S on the load L, the tensioning wheel 26 must be allowed to rollback subsequent to forming the strap weld. Tension is maintained during welding and rollback is then permitted, following welding, to allow for removal of the tool 10 from the load L. The present brake system 12 allows this rollback without excessive slack in the strap S, in an arrangement that eliminates complex gearing and/or pneumatics systems.

All patents referred to herein, are hereby incorporated herein by reference, whether or not specifically do so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A brake assembly for a tensioning motor for a strapping tool, the motor having a housing and having an output shaft operably connected to a tensioning wheel, the tensioning wheel rotating in a first direction to tension a strap and in a second reverse direction to relieve tension in the strap, the brake assembly comprising:

a one-way bearing operably connected to the motor output shaft to permit the shaft to rotate relative to the bearing in the first direction and to stop rotation of the shaft relative to the bearing in the reverse direction, the bearing having at least two stop members thereon;

a brake element operably mounted to the motor movable toward and away from the bearing for movement into and out of engagement with one of the bearing stop members, the brake element stopping reverse rotation of the motor shaft and bearing when the brake element is engaged with one of the bearing stop members;

a brake release operably connected to the brake element for moving the brake element into and out of engagement with the one of the bearing stop members;

a biasing element for biasing the brake element into engagement with the one of the bearing stop members, wherein when the brake is engaged with the one of the bearing stop members, the motor can freely rotate in the first direction and cannot rotate in the second reverse direction, and when the brake release moves the brake element out of engagement with the one of the bearing stop members, the motor can freely rotate in the second reverse direction until the brake release is reengaged with one of the bearing stop members.

2. The brake assembly in accordance with claim 1 wherein the brake release is pivotally mounted to the motor housing by a pivot.

3. The brake assembly in accordance with claim 2 wherein the brake release includes a finger release spaced from the pivot and wherein the brake element is operably connected to the brake release between the finger release and the pivot.

4. The brake release in accordance with claim 3 wherein the biasing element is disposed between the pivot and the finger release.

5. The brake assembly in accordance with claim 1 including a cam operably connecting the brake release and the brake element, the cam configured to translate movement of the brake release into an opposite movement of the brake element.

6. The brake assembly in accordance with claim 5 wherein the cam includes a central disk portion and a pair of pins extending outwardly from opposing side surfaces of the disk, the pins disposed about 180 degrees from one another, and wherein the brake release and the brake element each include a slot to receive their respective pins.

7. The brake release in accordance with claim 6 wherein the biasing element is disposed between the finger release and the cam.

8. The brake release in accordance with claim 1 wherein the bearing includes a circumferential trough formed therein and includes outwardly extending projections forming the bearing stop members, the brake element contacting the bearing stop members to prevent rotation of the motor shaft in the reverse direction.

9. The brake release in accordance with claim 8 including two bearing stop members.

10. A tensioning motor for a strapping tool comprising:

a housing;

an output shaft, the output shaft operably connected to an associated tension wheel rotatable in a first direction to tension a strap and in a second reverse direction to relieve tension in the strap;

a brake assembly including a one-way bearing operably connected to the motor output shaft to permit the shaft to rotate relative to the bearing in the first direction and to stop rotation of the shaft relative to the bearing in the reverse direction, the bearing having at least two stop members thereon, a brake element operably mounted to the housing movable toward and away from the bearing for movement into and out of engagement with one of the bearing stop members, the brake element stopping reverse rotation of the motor shaft and bearing when the brake element is engaged with one of the bearing stop members, a brake release mounted to the housing, the brake release operably connected to the brake element for moving the brake element into and out of engagement with the one of the bearing stop members, a biasing element for biasing the brake element into engagement with the one of the bearing stop members, wherein when the brake element is engaged with the one of the bearing stop members, the motor can freely rotate in the first direction and cannot rotate in the second reverse direction, and when the brake release moves the brake element out of engagement with the one of the bearing stop members, the motor can freely rotate in the second reverse direction until the brake release is reengaged with one of the bearing stop members.

11. The tensioning motor in accordance with claim 10 wherein the brake release is pivotally mounted to the motor housing by a pivot.

12. The tensioning motor in accordance with claim 11 wherein the brake release includes a finger release spaced from the pivot and wherein the brake element is operably connected to the brake release between the finger release and the pivot.

13. The tensioning motor in accordance with claim 12 wherein the biasing element is disposed between the pivot and the finger release.

14. The tensioning motor in accordance with claim 10 including a cam operably connecting the brake release and the brake element, the cam configured to translate movement of the brake release into an opposite movement of the brake element.

15. The tensioning motor in accordance with claim 14 wherein the cam includes a central disk portion and a pair of pins extending outwardly from opposing side surfaces of the disk, the pins disposed about 180 degrees from one another, and wherein the brake release and the brake element each include a slot to receive their respective pins.

16. The tensioning motor in accordance with claim 15 wherein the biasing element is disposed between the finger release and the cam.

17. The tensioning motor in accordance with claim 10 wherein the bearing includes a circumferential trough formed therein and includes outwardly extending projections forming the bearing stop members, the brake element contacting the bearing stop members to prevent rotation of the motor shaft in the reverse direction.

18. The tensioning motor in accordance with claim 17 including two bearing stop members.

* * * * *